US009205478B2

(12) United States Patent
Trubert

(10) Patent No.: US 9,205,478 B2
(45) Date of Patent: Dec. 8, 2015

(54) DEVICE AND METHOD FOR FORMING BENDS IN TUBULAR WORK PIECES

(75) Inventors: Franz Trubert, Munich (DE); Christine Trubert, legal representative, Vienna (AT)

(73) Assignee: Magna International Inc., Aurora, Ontario (CA)

( * ) Notice: Subject to any disclaimer, the term of this patent is extended or adjusted under 35 U.S.C. 154(b) by 277 days.

(21) Appl. No.: 13/702,253

(22) PCT Filed: Jun. 9, 2011

(86) PCT No.: PCT/CA2011/000695

§ 371 (c)(1), (2), (4) Date: Dec. 10, 2012

(87) PCT Pub. No.: WO2011/153634

PCT Pub. Date: Dec. 15, 2011

(65) Prior Publication Data

US 2013/0160513 A1 Jun. 27, 2013

Related U.S. Application Data

(60) Provisional application No. 61/352,921, filed on Jun. 9, 2010.

(51) Int. Cl.
*B21D 9/10* (2006.01)
*B21D 7/08* (2006.01)

(52) U.S. Cl.
CPC ... *B21D 9/10* (2013.01); *B21D 7/08* (2013.01)

(58) Field of Classification Search
CPC ..... B21D 7/08; B21D 9/05; B21D 7/14; B21D 9/10; B21B 13/008; B21B 17/02; B21B 19/12; B21B 31/22; B21B 31/20; B21B 2031/20
USPC ..... 72/306, 307, 367.1, 369, 370.01, 224, 72/167, 78, 136, 173–175
See application file for complete search history.

(56) References Cited

U.S. PATENT DOCUMENTS 7,159,432 B2 * 1/2007 Schule ..... 72/167

FOREIGN PATENT DOCUMENTS

| | | | |
|---|---|---|---|
| JP | 2002066658 A | | 3/2002 |
| JP | 2003275823 A | * | 9/2003 |
| JP | 20020080195 A | | 9/2003 |

OTHER PUBLICATIONS

Machine translation of JP 2003275823 A.*

*Primary Examiner* — Shelley Self
*Assistant Examiner* — Peter Iannuzzi
(74) *Attorney, Agent, or Firm* — Dickinson Wright PLLC

(57) ABSTRACT

A system for forming bends in a portion of a tubular work piece includes a roller assembly having rollers. The work piece is supported such that the portion thereof is aligned with the rollers along an axial direction, and such that the work piece can be advanced in the axial direction. At least some of the rollers are guided along a path around the perimeter of the work piece, such that a pressure exerted by the rollers on the work piece increases from a minimum value to a maximum value along a first half of the path and decreases from the maximum value to approximately the minimum value along a second half of the path. The system includes an adjuster assembly for moving the roller guide structure along a direction that is inclined relative to the axial direction, for varying the maximum value of the applied pressure.

38 Claims, 13 Drawing Sheets

DEVICE AND METHOD FOR FORMING BENDS IN TUBULAR WORK PIECES

CROSS-REFERENCE TO RELATED APPLICATION

This U.S. National Stage Patent Application claims the benefit of International Patent Application Serial No. PCT/CA2011/000695 filed on Jun. 9, 2011, entitled "Device And Method For Forming Bends In Tubular Work Pieces," and U.S. Provisional Application No. 61/352,921 filed Jun. 9, 2010, the entire disclosures of these applications being considered part of the disclosure of this application and hereby incorporated by reference.

FIELD OF THE INVENTION

The instant invention relates generally to processes for forming tubular work pieces, and more particularly to an apparatus and a method for forming a bend or a curve in a section of a tubular work piece.

BACKGROUND OF THE INVENTION

In manufacturing industries, such as for instance the automotive industry, often it is desirable to form tubular work pieces that are curved or bent. Some non-limiting examples of applications that are specific to the automotive industry include exhaust system components, frame/chassis components, conduits, etc. Non-automotive applications include copper tube plumbing, furniture frames, boat railings, staircase components, signage, ornamental ironwork, etc. Generally, round stock is used in tube bending. However, square and rectangular tubes and pipes may also be bent in order to meet job-specific requirements.

Rotary draw bending is a known technique for forming a curved section in a tubular work piece. In particular, rotary draw bending is an example of a "form bound" bending procedure in which the tubular work piece is clamped and drawn into the shape of a forming die. A variety of single or multiple bends may be formed in this way, so as to shape the work piece into a desired form. Advantageously, rotary draw bending can be used to form complex shapes out of different types of ductile metal tubing. Unfortunately, a different die set is required for forming each different bending radius.

An example of a freeform bending process is three-roll push bending, in which a tubular work piece is guided between a bending-roll and supporting-rolls. The position of the bending-roll defines the bending radius. Although three-dimensional shaping of tubular work pieces is possible, this technique is best suited for forming simple bends in one plane.

It would be beneficial to provide a method and an apparatus for forming a bend in a portion of a tubular work piece, which overcomes at least some of the above-mentioned limitations of the prior art.

SUMMARY OF THE INVENTION

According to one aspect, the invention is directed to a method of forming a bend in a portion of a tubular work piece, comprising: providing a tubular work piece absent a bend in the portion; using a plurality of rollers, applying non-uniform pressure around the perimeter of the portion of the tubular work piece; and, advancing the tubular work piece in an axial direction during the step of applying the non-uniform pressure, wherein each roller of the plurality of rollers is guided along a path that runs around the perimeter of the portion of the tubular work piece and transverse to the axial direction, and each roller applies the non-uniform pressure while being guided along said path, such that the tubular work piece is elongated to different extents around the perimeter of the portion of the tubular work piece, thereby forming the bend.

According to another aspect, the invention is directed to a system for forming a bend in a portion of a tubular work piece, comprising: a roller assembly comprising a plurality of rollers; a support assembly for supporting the tubular work piece such that the portion of the tubular work piece is aligned with the plurality of rollers along an axial direction, and for advancing the tubular work piece in the axial direction; a roller guide structure configured to guide at least some of the rollers of the plurality of rollers along a path that runs around a perimeter of the portion of the tubular work piece and transverse to the axial direction, such that a pressure that is exerted by each of the at least some of the rollers on the portion of the tubular work piece increases from a minimum value to a maximum value along a first half of the path and decreases from the maximum value to approximately the minimum value along a second half of the path, the first half of the path not overlapping with the second half of the path; and, an adjuster assembly for moving the roller guide structure along a direction that is inclined relative to the axial direction, for varying the maximum value of the applied pressure.

According to another aspect, the invention is directed to a system for forming a bend in a first portion of a tubular work piece, comprising: a clamping element for clamping the tubular work piece about a second portion thereof and for aligning the clamped second portion of the tubular work piece along an axial direction; a roller guide structure having an inwardly facing surface that is inclined, relative to the axial direction, such that the surface defines a substantially frusto-conical volume; a tube feeding assembly for feeding the tubular work piece along the axial direction, so as to position the first portion of the tubular work piece at least partially within the substantially frusto-conical volume; a roller assembly comprising a plurality of rollers, each roller of the plurality of rollers disposed in rolling engagement with the surface of the roller guide structure, and each roller being guided along a path that runs around a perimeter of the first portion of the tubular work piece and transverse to the axial direction; a support structure; and, an adjuster assembly interconnecting the roller guide structure and the support structure, the adjuster assembly comprising a guide mechanism defining a guided path that is inclined relative to the axial direction for moving the roller guide structure in both a vertical and a horizontal direction relative to the roller assembly, wherein moving the roller guide structure along the guided path varies an amount of pressure that is exerted on the tubular work piece by the rollers to a larger extent within a first section of the perimeter of the tubular work piece than within a second section of the perimeter of the tubular work piece, the first section of the perimeter being opposite the second section of the perimeter.

According to yet another aspect, the invention is directed to a system for forming a bend in a first portion of a tubular work piece, comprising: a clamping element for clamping the tubular work piece about a second portion thereof and for aligning the clamped second portion of the tubular work piece along an axial direction; a roller guide structure having an inwardly facing surface that is inclined, relative to the axial direction, such that the surface defines a substantially frusto-conical volume; a tube feeding assembly for feeding the tubular work piece along the axial direction, so as to position the first portion of the tubular work piece at least partially within the substantially frusto-conical volume; a roller assembly comprising a plurality of first rollers and a plurality of second rollers, each one of the plurality of second rollers disposed in a fixed arrangement relative to a different one of the plurality of first rollers, each first roller of the plurality of first rollers disposed in rolling engagement with the surface of the roller guide structure, and each second roller of the plurality of second rollers being guided along a path that runs around a perimeter of the first portion of the tubular work piece and transverse to the axial direction; a support structure; and, an adjuster assembly interconnecting the roller guide structure and the support structure, the adjuster assembly comprising a guide mechanism defining a guided path that is inclined relative to the axial direction for moving the roller guide structure in both a vertical and a horizontal direction relative to the roller assembly, wherein moving the roller guide structure along the guided path varies an amount of pressure that is exerted on the tubular work piece by each of the second rollers to a larger extent within a first section of the perimeter of the tubular work piece than within a second section of the perimeter of the tubular work piece, the first section being opposite the second section.

BRIEF DESCRIPTION OF THE DRAWINGS

The present invention will now be described by way of example only, with reference to the attached drawings, wherein similar reference numerals denote similar elements throughout the several views, and in which.

DETAILED DESCRIPTION OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
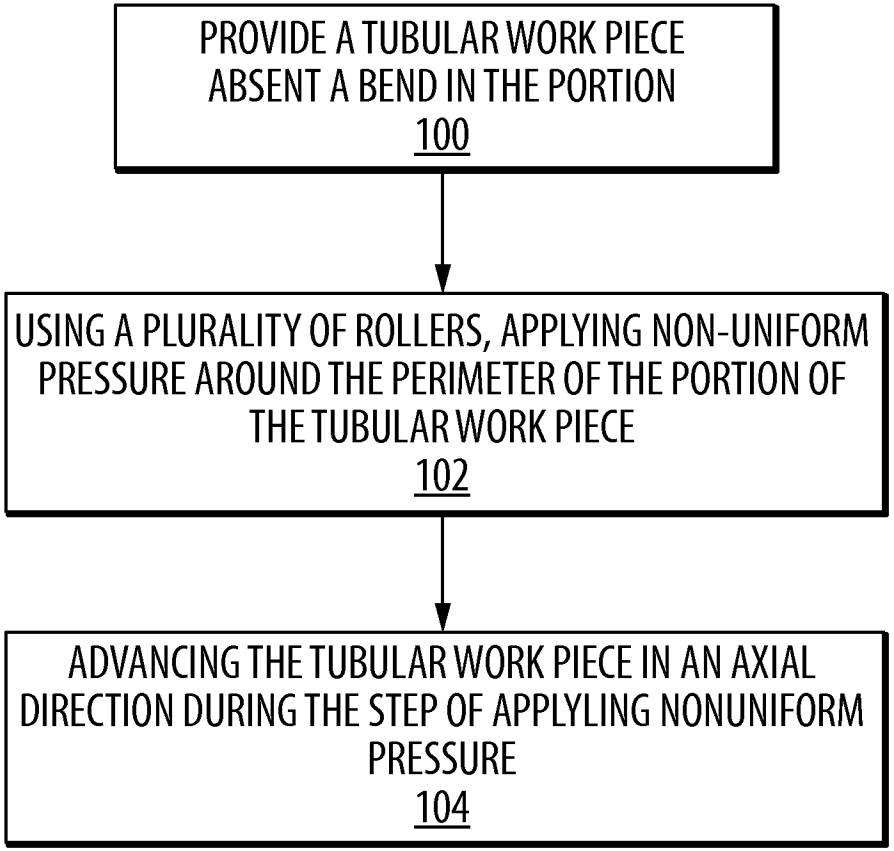
FIG. 1 is a simplified flow diagram of a method according to an embodiment of the instant invention.

Reference is made to FIG. 1, which shows a simplified flow diagram of a method for forming curves or bends in a portion of a tubular work piece, according to an embodiment of the instant invention. The method is based on the principle that the volume of a work piece remains constant during the forming process. A tubular work piece is provided at step 100, absent a bend in the portion. For instance, the tubular work piece is a section of straight stock having a circular, elliptical, rectangular or even an irregular cross-section. Absent a bend or a curve, the wall thickness of the tubular work piece within the portion is generally uniform when viewed in a cross-section that is taken in a plane normal to the axial direction of the work piece. Alternatively, a tubular work piece having initially a non-uniform wall thickness can be bent in accordance with embodiments of the instant invention. In order to provide a more stable process, the portion of the tubular work piece is supported by an inner mandrel. Optionally, one or more bends are present in other portions of the tubular work piece.

Figure 2B:
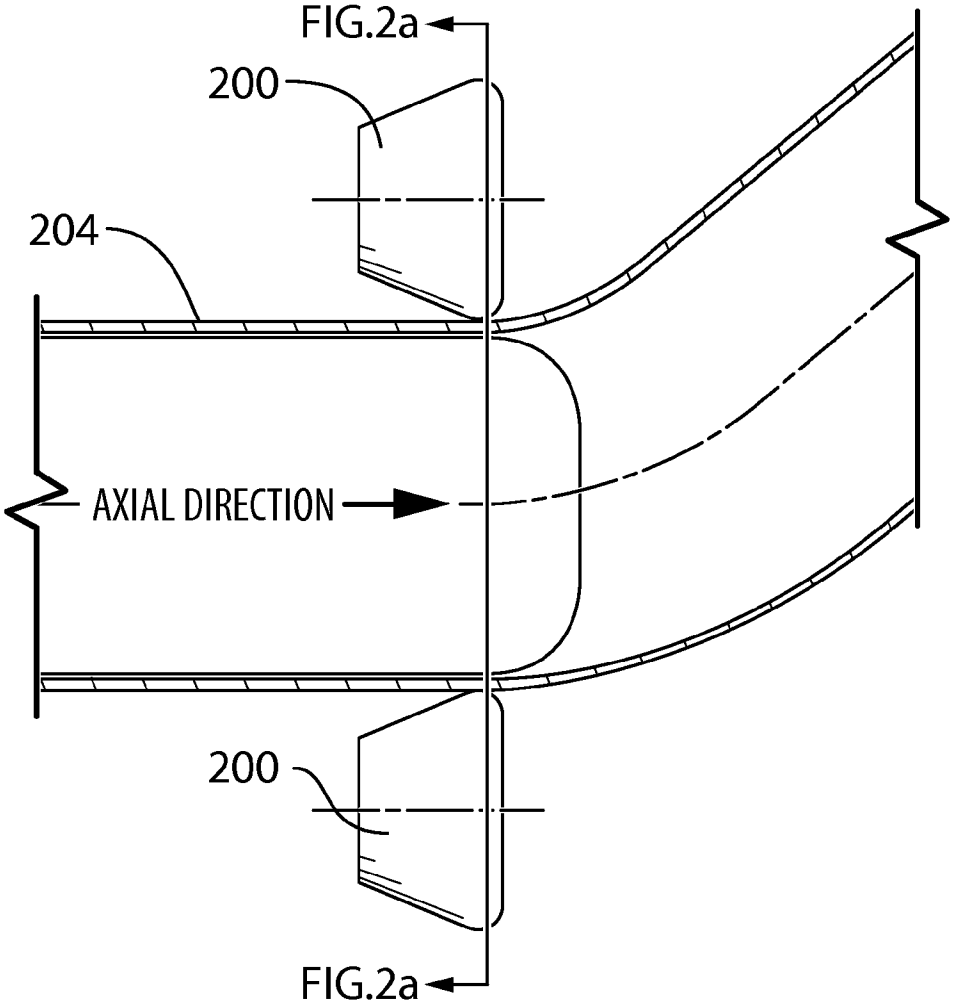
FIG. 2*b* is a cross-sectional view taken in a plane that is parallel to the axial direction of the tubular work piece of FIG. 2*a*, showing asymmetric reduction of wall-thickness during forming of the bend in the portion of the tubular work piece.
Figure 2A:
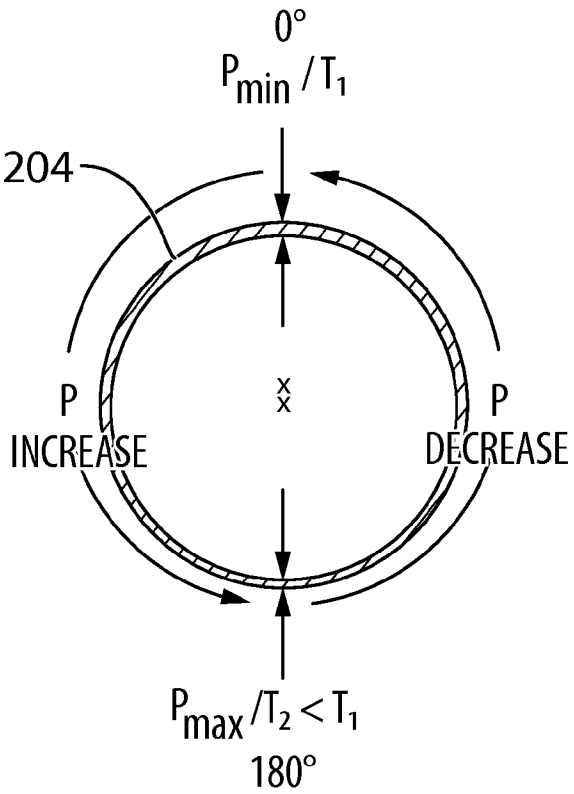
FIG. 2*a* is a cross-sectional view taken in a plane that is normal to the axial direction of a tubular work piece, showing asymmetric reduction of wall-thickness during forming of a bend in a portion of the tubular work piece.

Referring also to FIGS. 2*a* and 2*b*, at step 102 a plurality of rollers 200 is used for applying non-uniform pressure around the perimeter of the portion of the tubular work piece 204. In particular, the rollers 200 of the plurality of rollers are guided along an asymmetric path, which is vastly exaggerated in FIG. 2*a*, around the outer surface of the portion of the tubular work piece. That is to say, the rollers 200 are guided along a generally circular path, which is not coaxial with the central longitudinal axis of the tubular work piece 204. More particularly, the upper "x" in FIG. 2*a* denotes the center of the circular roller path, which has been shifted upward relative to the lower "x" denoting the central longitudinal axis of the tubular work piece 204. As the rollers 200 travel along the this path around the tubular work piece 204, the pressure that is exerted on the outer surface of the tubular work piece 204 varies between a minimum value ($P_{min}$) at about 0° and a maximum value ($P_{max}$) at about 180° over a first half of the path (denoted as "P increases"), and varies between the maximum value at about 180° and approximately the minimum value ($P_{min}$) at about 0° over a second half of the path (denoted as "P decreases"). At step 104, the tubular work piece 204 is advanced (i.e., fed) in an axial direction as indicated by the arrow in FIG. 2*b*. Step 104 is performed during performance of step 102, such that the plurality of rollers 200 continues to receive a straight section of the tubular work piece as the bend or curve is being formed. The axial feed of the tubular work piece, as well as the rotary speed and geometry of the rollers 200, affects the surface finish of the bend or curve that is formed, and therefore comprise parameters that may be optimized in order to obtain a desired finish, depending on the requirements of a particular application.

FIGS. 2*a* and 2*b* show that the reduction of the wall thickness is not uniform around the cross section of the portion of the tubular work piece 204. Rather, the wall thickness $T_1$ at 0° is greater than the wall thickness $T_2$ at 180° after the curve or bend is formed within the portion of the tubular work piece. Since the volume of the wall material remains constant, the tubular work piece 204 is elongated to a greater extent at 180° than at 0°, such that a bend or a curve is formed in the portion of the tubular work piece with an outer radius at 180° and an inner radius at 0°. Optionally, the wall thickness is also somewhat reduced at 0° during forming of the bend or curve, but to a lesser extent than occurs at 180°. The bending radius is dependent on the reduction of the material thickness at the outer radius (i.e., 180°) relative to the reduction of the material thickness at the inner radius (i.e., 0°). As such, varying the pressure that is applied by the rollers at 180° allows the bending radius to be varied. Further, by varying the roller pressure and/or the axial feed of the tubular work piece, it is possible to form single radius curves or bends as well as progressive curves. Further still, the tube diameter may be reduced either with or without reducing the wall thickness of the tubular work piece and either with or without forming a bend in the portion of the tubular work piece. In particular, the tubular work piece is supported by an inner mandrel. When the mandrel is not advanced fully into the portion of the tube that is being formed by the rollers, then the diameter of the tubular work piece may be reduced, without correspondingly reducing the wall thickness, due to elongation of the tubular work piece. When the rollers apply pressure symmetrically, no bend or curve is formed within the portion of the tubular work piece.

Various combinations of operating modes, such as for instance tube bending mode, tube elongation mode and tube-diameter reducing mode, may be combined in order to achieve a desired geometry of the tubular work piece. In addition a measuring system, such as for instance an optical measuring system, optionally may be used for providing feedback to a controller, such as for instance a programmable logic controller (PLC) or a suitable computer, during forming of the tubular work piece. Based on the feedback, the controller adjusts process parameters such as for instance one or more of roller pressure, rate of axial feed of the tubular work piece, etc., in order to obtain an accurate bend geometry within the portion of the tubular work piece and/or desired surface quality characteristics.

It should be noted that only two rollers 200 of the plurality of rollers are shown in the cross-sectional view that is presented in FIG. 2*b*. Of course, another two rollers are provided that are not in the plane of the cross sectional view. Although the embodiments that are described herein employ four rollers 200, optionally more than four rollers or less than four rollers may be employed. That said, four rollers provide good stability and can be accommodated readily around a tubular work piece.

Figure 3:
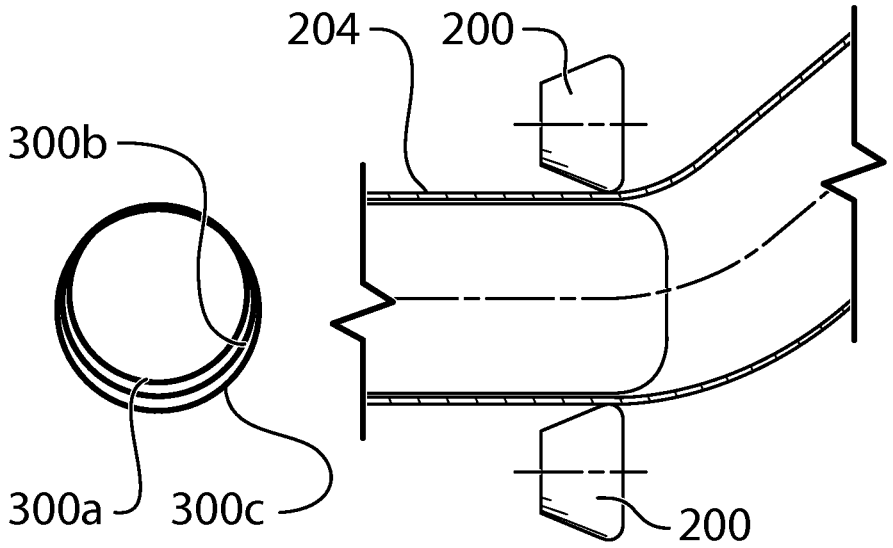
FIG. 3 shows a tube-bending mode of operation.
Figure 4:
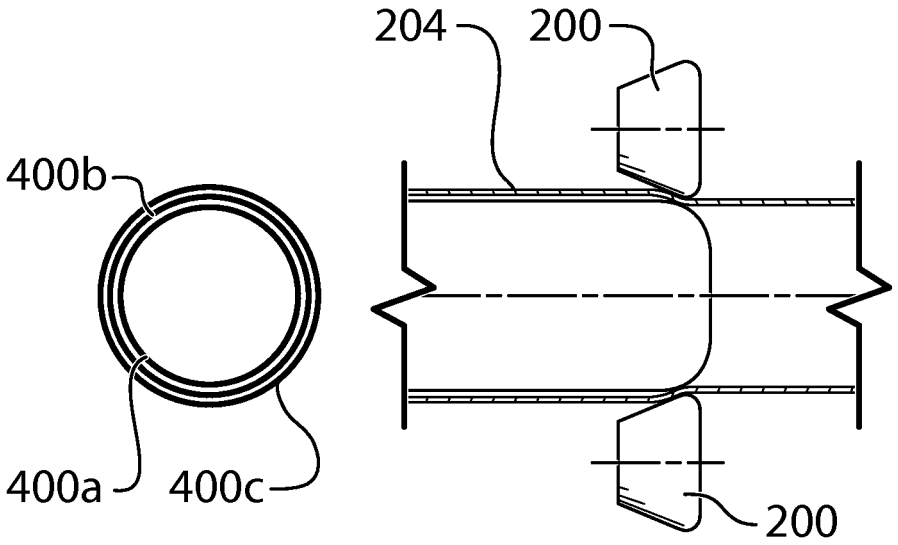
FIG. 4 shows a tube-diameter reducing mode of operation.

Referring now to FIG. 3, shown is a cross-sectional view taken in a plane along the axial direction and showing a tubular work piece 204 being formed according to a bending mode of operation. FIG. 4 shows a cross-sectional view taken in a plane along the axial direction and showing a tubular work piece 204 being formed according to a tube-diameter reducing mode of operation. In addition, representations showing a plurality of different roller paths 300*a*, 300*b*, 300*c*, etc., and 400*a*, 400*b*, 400*c*, etc., are presented adjacent to the cross-sectional views in FIGS. 3 and 4, respectively. With reference to FIG. 3, the different roller paths 300*a*, 300*b*, 300*c* all pass through an approximately common point at about 0°, were the pressure that is exerted on the tubular work piece is a minimum value, but each roller path 300*a*, 300*b*, 300*c* has a different diameter. As the diameter of the roller path is reduced, the pressure that is applied to the portion of the tubular work piece at about 180° increases. As a result, the bend radius of the tubular work piece 204 decreases, or in other words a "tighter" bend is achieved. Conversely, with reference to FIG. 4, the different roller paths 400*a*, 400*b*, 400*c* do not pass through a common point, but each roller path 400*a*, 400*b*, 400*c* once again has a different diameter. In this case, as the diameter of the roller path decreases the pressure that is applied to the portion of the tubular work piece around the whole perimeter thereof is increased more or less uniformly. Since pressure is being applied more or less uniformly around the perimeter of the tubular work piece, the tubular work piece is elongated without forming a bend in the portion.

Optionally, non-circular roller paths may be defined instead of the circular roller paths shown in FIGS. 3 and 4. For instance, elliptical or other roller path shapes may be defined such that the roller pressure that is exerted on the tubular work piece varies in a predetermined way.

Figure 5:
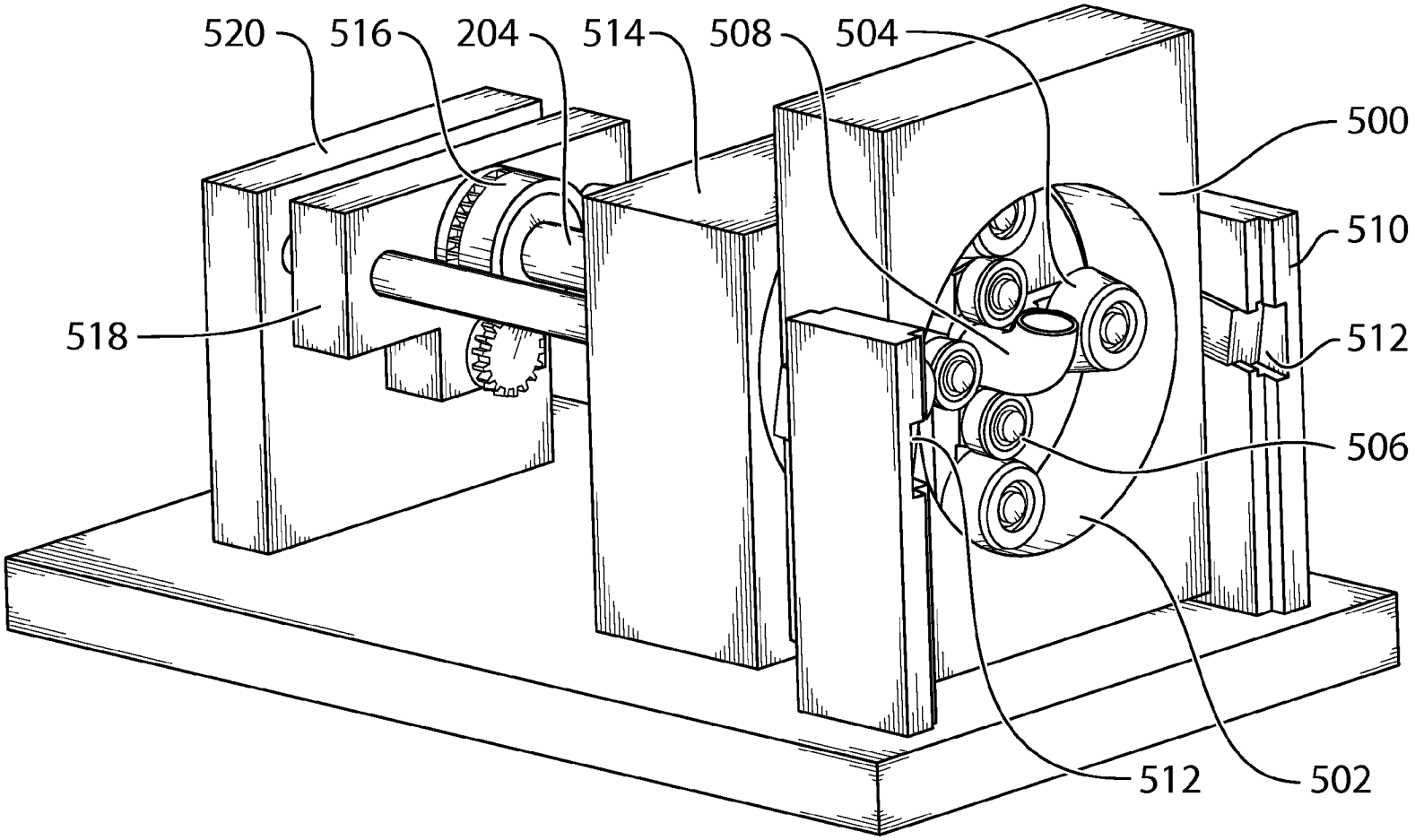
FIG. 5 is a simplified perspective view of an apparatus according to a first embodiment of the instant invention.
Figure 6:
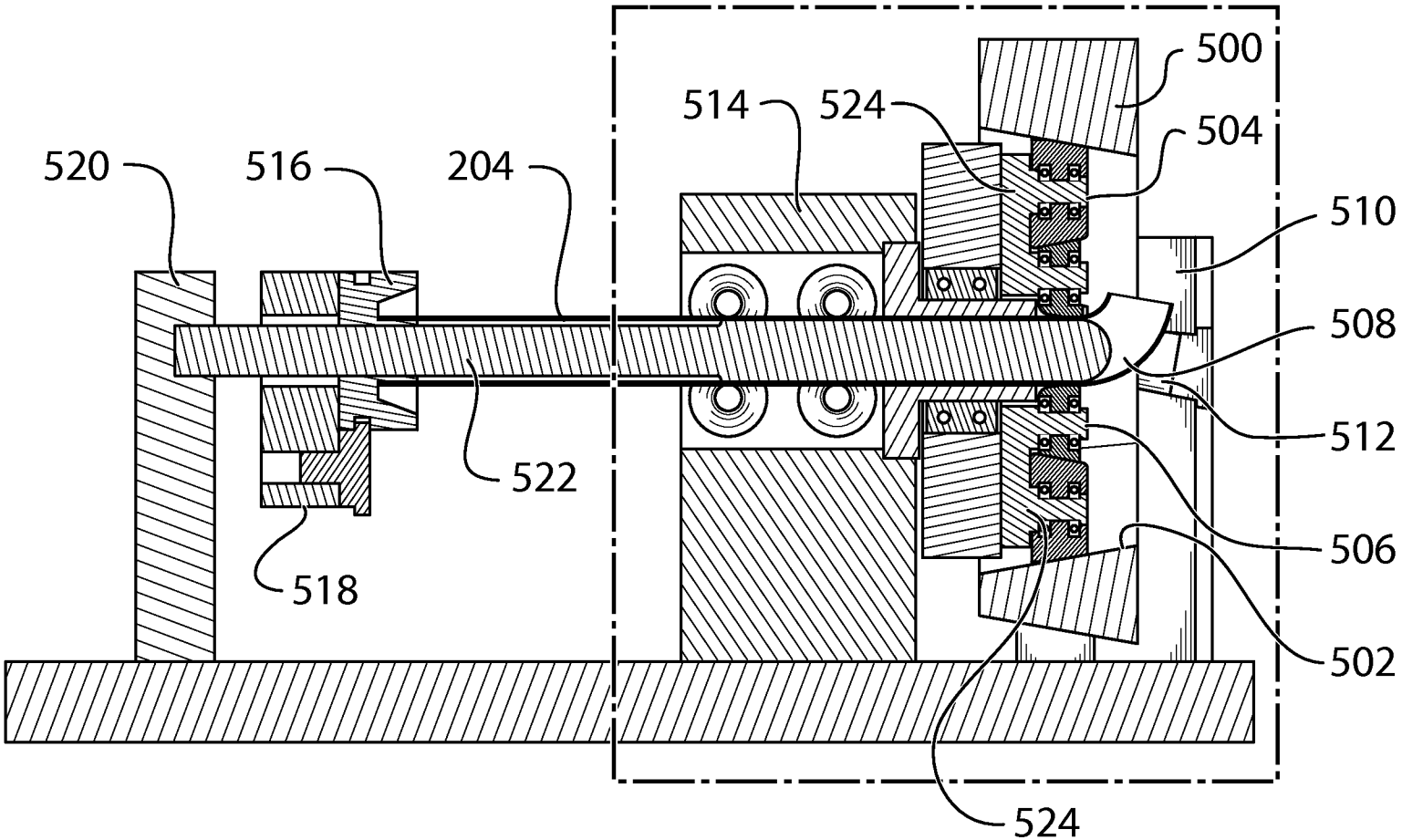
FIG. 6 is a simplified cross-sectional side view of the apparatus of FIG. 5.

Referring now to FIG. 5, shown is a simplified perspective view of an apparatus according to a first embodiment of the instant invention. FIG. 6 shows a side cross-sectional view of the apparatus of FIG. 5. The apparatus according to the first embodiment includes a roller guide structure 500 having a surface 502, and a roller assembly comprising a plurality of first rollers 504 and a plurality of second rollers 506. In the specific and non-limiting example that is shown in FIG. 5, four first-rollers 504 and four second-rollers 506 are illustrated. Only two first rollers 504 and two second rollers 506 are visible in the plane of the cross-section of FIG. 6. Optionally, a number of first rollers 504 and a number of second rollers 506 other than four may be provided.

Referring still to FIGS. 5 and 6, each second roller 506 is mechanically coupled to a different one of the first rollers 504. During use, each first roller 504 is in rolling engagement with the surface 502 of the roller guide structure 500, and each second roller 506 is aligned with and in rolling engagement with an outer surface of a portion 508 of the tubular work piece 204. It is within the portion 508 of the tubular work piece 204 that a bend or curve is formed.

A support structure 510 supports the roller guide structure 500 via an adjuster assembly 512. The adjuster assembly 512 is configured to support relative movement between the support structure 510 and the roller guide structure 500. In the specific and non-limiting example that is shown in FIGS. 5 and 6, the adjuster assembly 512 includes a rail that slidingly engages a track. Alternatively, a different mechanism is provided for moving the roller guide structure 500 relative to the support structure 510. It should be noted that the roller assembly is fixed in the axial direction, such that the adjuster assembly supports relative movement between the roller guide structure 500 and the rollers 504/506.

Figure 7:
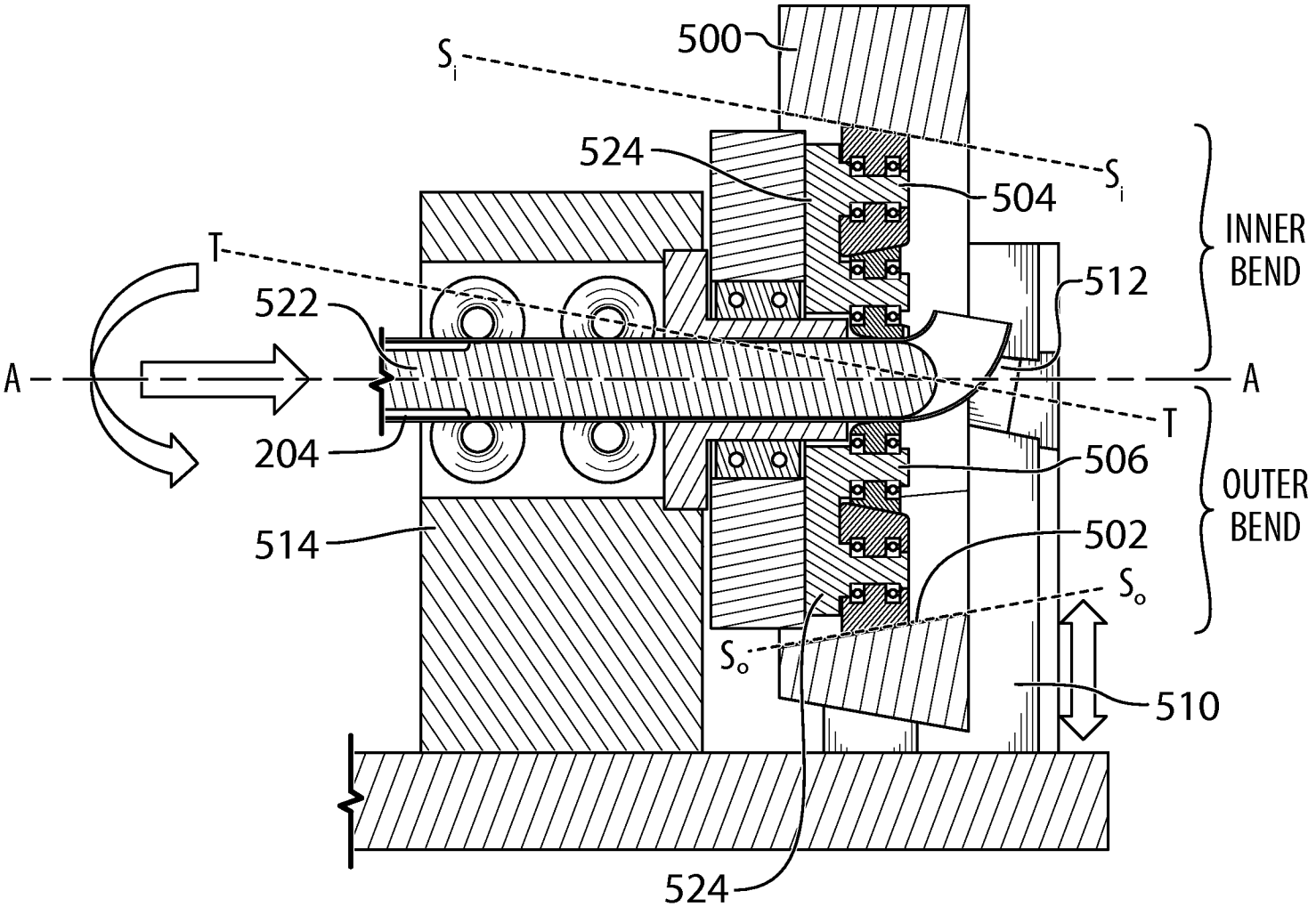
FIG. 7 is an enlargement of the portion of FIG. 6 within the dashed-line rectangle.

Referring also to FIG. 7, shown is an enlarged view of a portion of the apparatus that is enclosed by the dashed-line rectangle in FIG. 6. As is shown in FIG. 7, the roller assembly 504/506, the roller guide structure 500 and the adjuster assembly 512 cooperate to form an "inner bend" and "an outer bend" in the portion 508 of the tubular work piece 204. In other words, the first rollers 504, the surface 502, the second rollers 506 and the adjuster assembly 512 are cooperatively designed, such that a roller pressure exerted by the second rollers 506 is distributed differently around the perimeter of the portion 508 of the tubular work piece 204. In the instant embodiment, the surface 502 of the roller guide structure 500 is inclined relative to the axial direction of the tubular work piece 204 (axial direction is denoted using dashed line A-A). The inclination of the surface 502 is denoted using dashed line $S_o$-$S_o$ in the outer bend region and using dashed line $S_i$-$S_i$ in the inner bend region. The direction of inclination along the dashed line $S_o$-$S_o$ is opposite the direction of inclination along the dashed line $S_i$-$S_i$, such that the surface 502 defines a frusto-conical shaped volume. Further, the track of the adjuster assembly 512 is also inclined relative to the axial direction, as denoted using dashed line T-T. The direction of inclination of the dashed line T-T is opposite the direction of inclination of the dashed line $S_o$-$S_o$, but is in the same direction as the direction of inclination of the dashed line $S_i$-$S_i$.

Moving the roller guide structure 500 along the inclined path T-T in FIG. 7, relative to the support structure 510, changes the position of the first rollers 504 relative to the surface 502. Since the surface 502 is inclined relative to the axial direction, varying the position of the first rollers 504 along the surface 502 changes the spacing between diametrically opposite portions of the surface 502 along which the first rollers 504 run. As a result, moving the roller guide structure 500 from left to right in FIGS. 6 and 7 allows the first rollers 504 to move radially outward. Since the second rollers 506 are fixed in the radial direction relative to the first rollers 504, the second rollers are caused to exert less pressure on the outer surface of the portion 508 of the tubular work piece. At the same time, the roller guide structure 500 also moves downwardly along the inclined path T-T, such that the pressure that is applied at 0° (i.e., the top of the tubular work piece in FIGS. 6 and 7) remains substantially constant, whilst the pressure that is applied at 180° (i.e., the bottom of the tubular work piece in FIGS. 6 and 7) is reduced. Similarly, moving the roller guide structure 500 from right to left in FIGS. 6 and 7 forces the first rollers 504 to move radially inward. Since the second rollers 506 are fixed in the radial direction relative to the first rollers 504, the second rollers are caused to exert more pressure on the outer surface of the portion 508 of the tubular work piece. At the same time, the roller guide structure 500 also moves upwardly along the inclined path T-T, such that the pressure that is applied at 0° remains substantially constant, whilst the pressure that is applied at 180° is increased. It should be noted that the inclination along line T-T and the inclination along line $S_i$-$S_i$ are selected such that the pressure that is applied at 0° remains substantially constant so as to avoid slippage between the portion 508 of the tubular work piece 204 and the second rollers 506.

Figure 8:
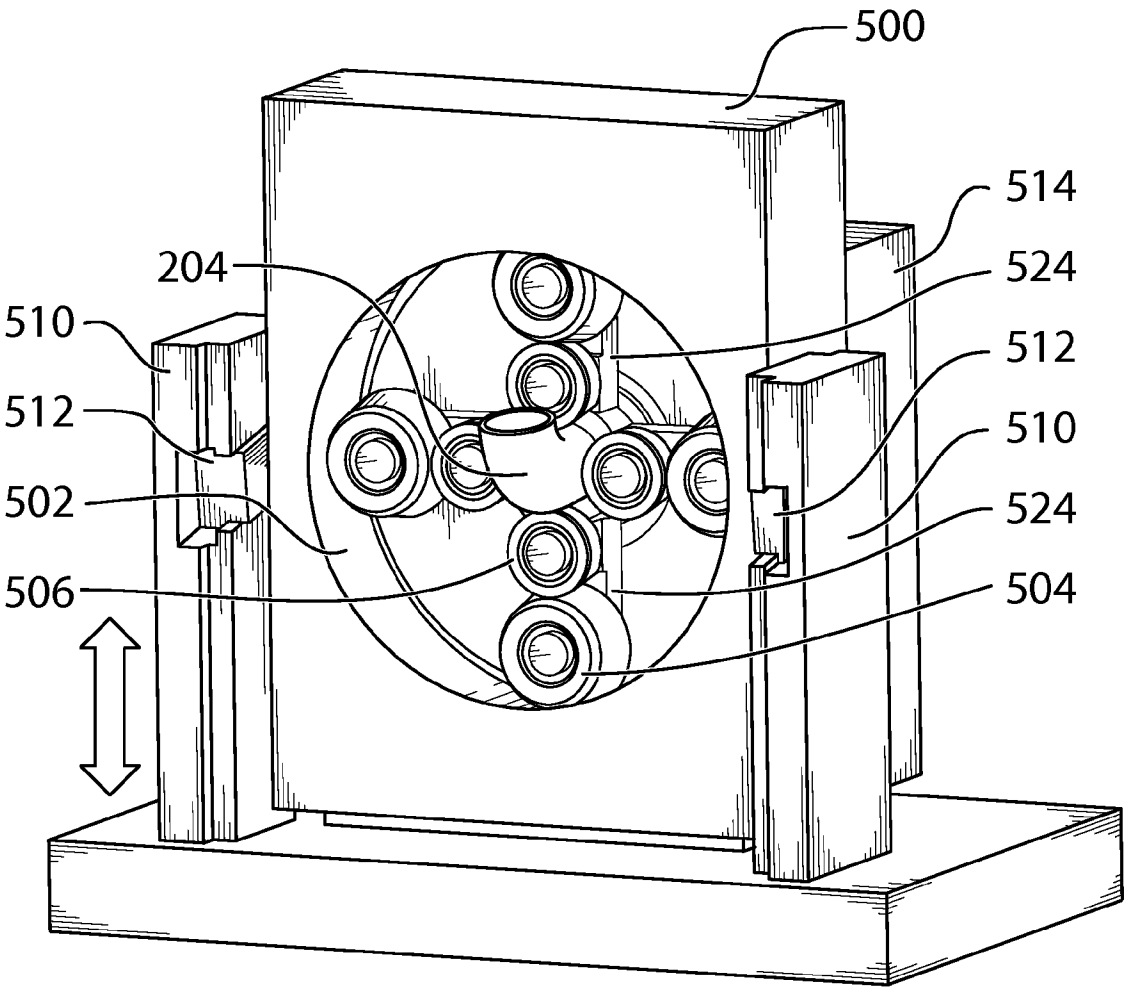
FIG. 8 is a simplified perspective view showing the roller assembly and the roller guide structure of the apparatus of FIG. 5.

The support structure 508 is vertically adjustable, for moving the roller guide structure 500 along the vertical direction as indicated using double-headed arrows in FIGS. 7 and 8. Vertically adjusting the position of the roller guide structure 500 affects the degree of asymmetry of the path of the second rollers 506 around the perimeter of the portion 508 of the tubular work piece 204. For instance, switching between the bending mode of operation that is shown in FIG. 3 and the tube-diameter reducing mode of operation that is shown in FIG. 4 is achieved by lowering the roller guide structure 500. When the roller guide structure 500 is lowered, the roller pressure that is exerted on the tubular work piece at 0° is increased, whilst the roller pressure that is exerted on the tubular work piece at 180° is decreased. When the central axis of the roller path is aligned with the longitudinal axis of the tubular work piece, then the pressure that is exerted around the perimeter of the tubular work piece 204 is more-or-less uniform. A curve or bend is not formed when the roller pressure is more-or-less uniform, but instead the tubular work piece is merely elongated and/or the diameter of the tubular work piece is reduced.

Referring still to FIGS. 5 and 6, the apparatus further includes a tubular work piece support assembly 514, which in the instant example includes a plurality of rollers for feeding the tubular work piece 204 in the axial direction. A tube-clamping device 516 is provided, in association with a tube turning device 518, for supporting the tubular work piece 204 and for rotating the tubular work piece such that bends or curves can be formed in different directions in different portions of the tubular work piece. Optionally, rotating the tubular work piece may be performed during bending, so as to form spirals or other three-dimensional shapes. A mandrel support 520 supports an inner mandrel 522, which is used to provide a more stable process. The mandrel 522 may extend past the location of the rollers in which case material wall thinning is achieved without reducing the tube diameter, or the mandrel 522 may be withdrawn slightly such that tube diameter reduction and tube elongation is achieved.

Radial frames 524, on which the first rollers 504 and the second rollers 506 are rotatably mounted, are shown in FIGS. 6 and 7. The first rollers 504 and the second rollers 506 are mounted onto the radial frames 524 such that the second rollers 506 roll on the first rollers 504. To this end, the first rollers 504 are tapered in a first direction that is complimentary to the direction of inclination of the surface 502, and the second rollers 506 are tapered in a second direction opposite the first direction so as to maximize the overlap of the first and second roller surface areas. The second rollers 506 have a curved surface where they engage the portion 508 of the tubular work piece 204.

FIG. 8 is a simplified perspective view showing the roller guide structure 500, the first rollers 504, the second rollers 506, the support structure and the adjuster assembly 512. FIG. 8 shows more clearly the relative arrangement of the first rollers 504 with respect to the second rollers 506. Radial frames 524 are visible behind the first rollers 504 and second rollers 506.

Figure 9:
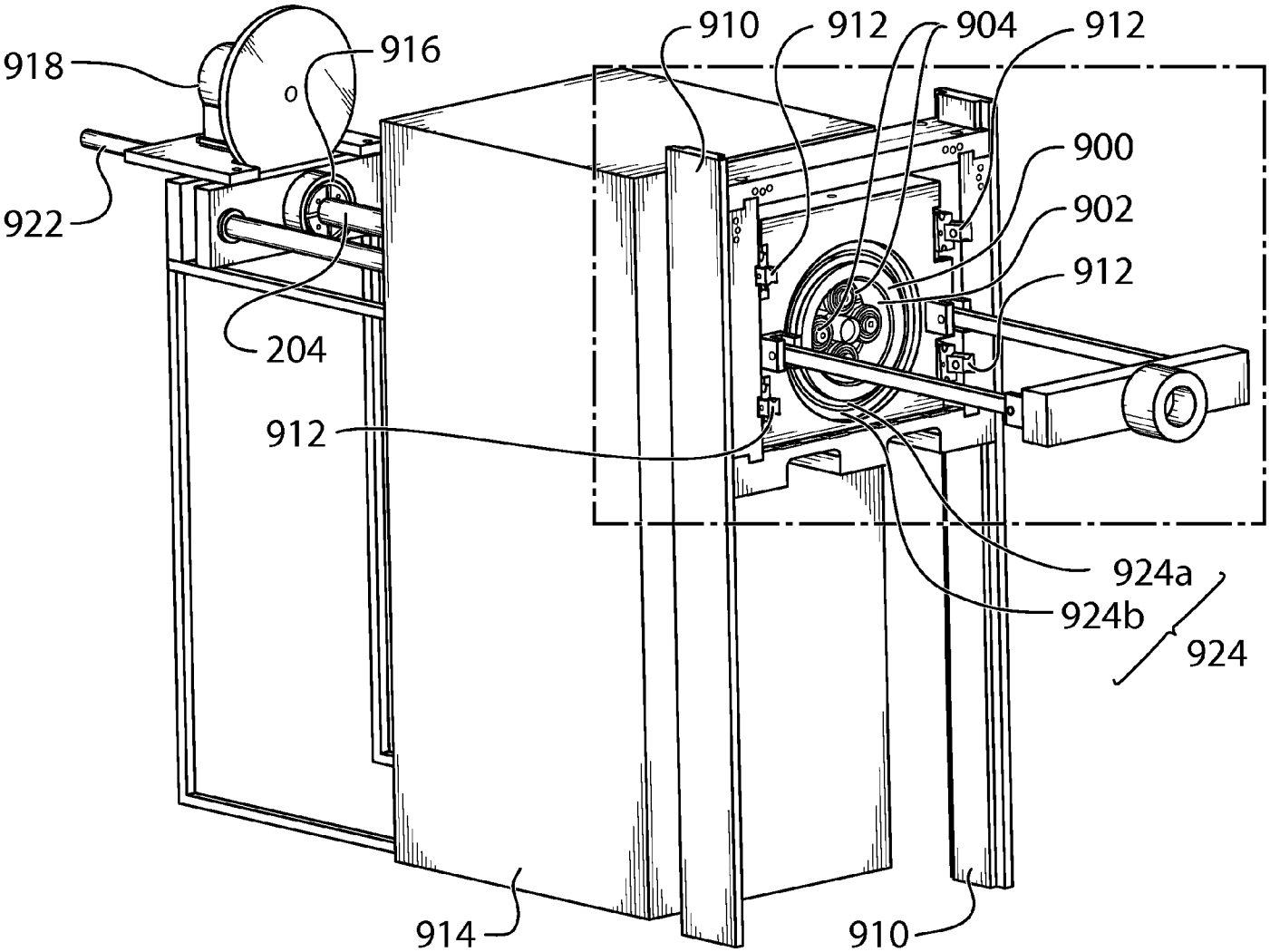
FIG. 9 is a simplified perspective view of an apparatus according to a second embodiment of the instant invention.
Figure 10:
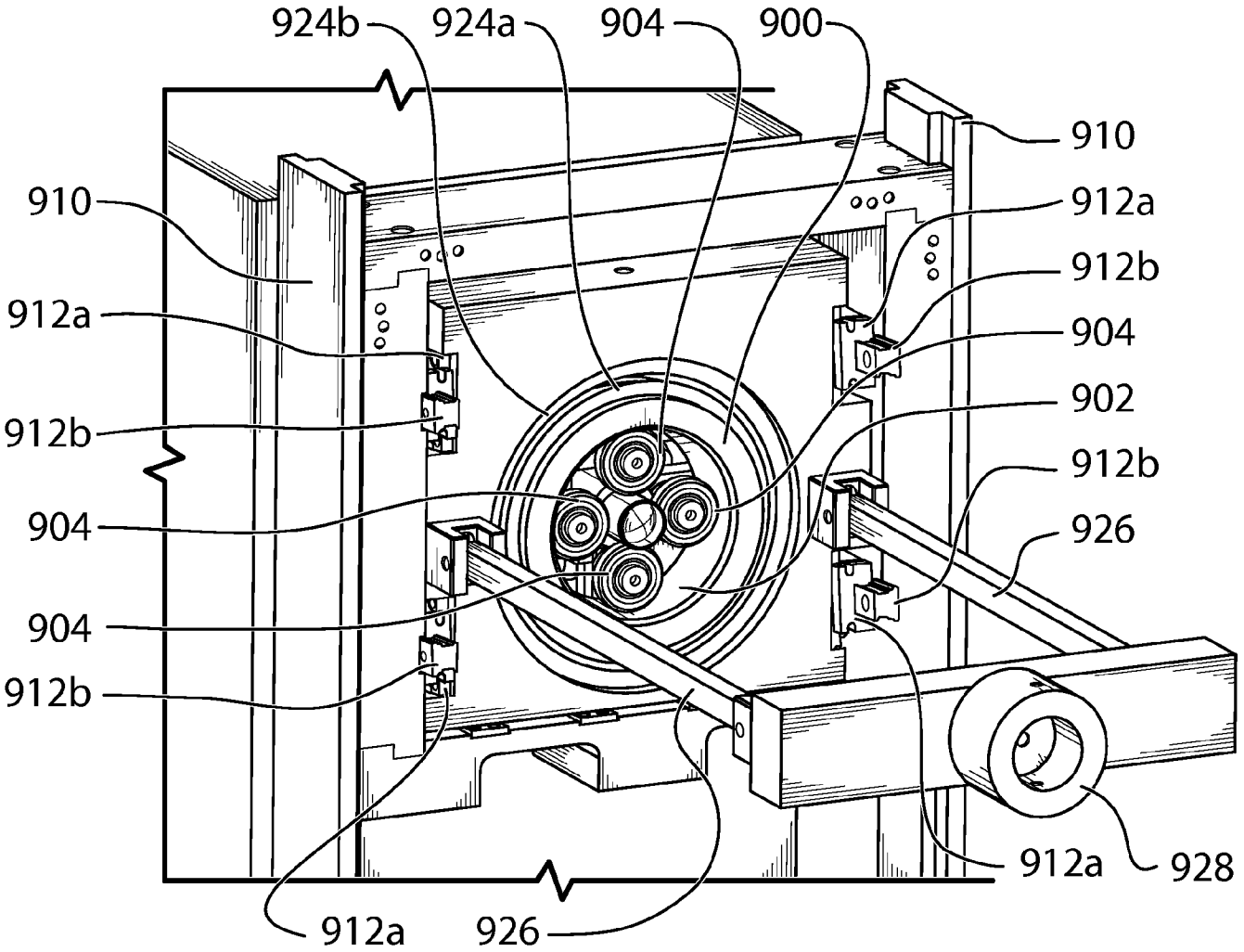
FIG. 10 is an enlargement of the portion of FIG. 9 within the dashed-line rectangle.
Figure 11:
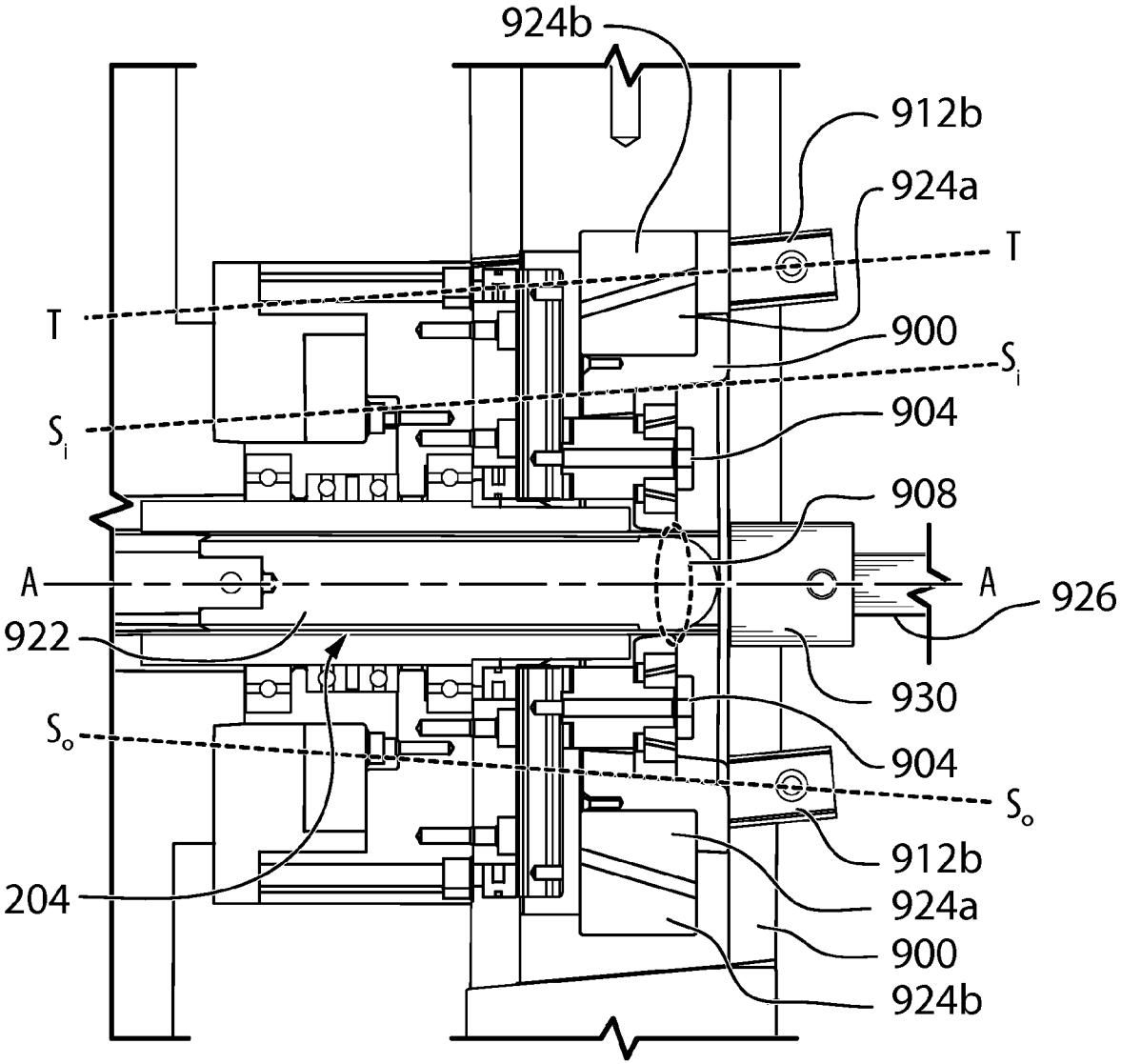
FIG. 11 is an enlarged, simplified cross-sectional side view of the portion of FIG. 9 within the dashed-line rectangle.

Reference will now be made to FIGS. 9-11, in which: FIG. 9 is a simplified perspective view of an apparatus according to a second embodiment of the instant invention; FIG. 10 is an enlarged view of the portion of FIG. 9 within the dashed-line rectangle; and, FIG. 11 is a side cross-sectional view of the portion of FIG. 9 within the dashed-line rectangle. The apparatus includes a roller guide structure 900 having a surface 902, and a roller assembly comprising a plurality of rollers 904. Each roller 904 is disposed in rolling engagement with the surface 902 of the roller guide structure 900, as well as a portion 908 of the tubular work piece 204. It is within the portion 908 that a bend or curve is to be formed.

Referring still to FIGS. 9-11, a support structure 910 supports the roller guide structure 900 via an adjuster assembly 912. The adjuster assembly 912 is configured to support relative movement between the support structure 910 and the roller guide structure 900. In the specific and non-limiting example that is shown in FIGS. 9-11, the adjuster assembly 912 includes a plurality of rails that each engages a respective track in a sliding fashion. For instance, in FIGS. 9-11 the adjuster assembly 912 comprises four sets of tracks 912*a* and rails 912*b*. Alternatively, a different mechanism is provided for supporting movement of the roller guide structure 900 relative to the support structure 910. Of course, it should be noted that the rollers 904 are fixed in the axial direction, such that the adjuster assembly 912 supports relative movement between the roller guide structure 900 and the rollers 904.

The roller guide assembly 900 is mounted to an inner race 924*a* of a bearing assembly 924. The inner race 924*a* is nested within an outer race 924*b*. Not illustrated rolling elements are disposed between the inner race 924*a* and the outer race 924*b*, such that the inner race 924*a* is rotatable relative to the outer race 924*b*. The roller 904, the roller guide structure 900, the bearing 924 and the adjuster assembly 912 cooperate to form an "inner bend" and "an outer bend" in the portion 908 of the tubular work piece 204. In other words, the rollers 904, the surface 902, the bearing 924 and the adjuster assembly 912 are cooperatively designed, such that roller pressure that is exerted by the rollers 904 is distributed non-uniformly around the perimeter of the portion 908 of the tubular work piece 204. In the instant embodiment, the surface 902 of the roller guide structure 900 is inclined relative to the axial direction of the tubular work piece 204 (axial direction is denoted using dashed line A-A in FIG. 11). The inclination of the surface 902 is denoted using dashed line $S_o$-$S_o$ in the outer bend region and using dashed line $S_i$-$S_i$ in the inner bend region. The direction of inclination along the dashed line $S_o$-$S_o$ is opposite the direction of inclination along the dashed line $S_i$-$S_i$, such that the surface 902 defines a frusto-conical shaped volume. Further, the track of the adjuster assembly 912 is also inclined relative to the axial direction, as denoted using dashed line T-T. The direction of inclination of the dashed line T-T is opposite the direction of inclination of the dashed line $S_o$-$S_o$, but is in the same direction as the direction of inclination of the dashed line $S_i$-$S_i$.

Moving the roller guide structure 900 along the inclined path T-T in FIG. 11, relative to the support structure 910, changes the position of the rollers 904 relative to the surface 902. Since the surface 902 is inclined relative to the axial direction, varying the position of the rollers 904 along the surface 902 changes the spacing between diametrically opposite portions of the surface 902 along which the rollers 904 run. As a result, moving the roller guide structure 900 from left to right in FIG. 11 forces the rollers 904 to move radially inward. This causes the rollers 904 to exert more pressure on the outer surface of the portion 908 of the tubular work piece 204. At the same time, the roller guide structure 900 also moves upwardly along the inclined path T-T, such that the pressure that is applied at 0° (i.e., the top of the tubular work piece in FIG. 11) remains substantially constant, whilst the pressure that is applied at 180° (i.e., the bottom of the tubular work piece in FIG. 11) is increased. Similarly, moving the roller guide structure 900 from right to left in FIG. 11 allows the rollers 904 to move radially outward, which causes the rollers 904 to exert less pressure on the outer surface of the portion 908 of the tubular work piece 204. At the same time, the roller guide structure 900 also moves downwardly along the inclined path T-T, such that the pressure that is applied at 0° remains substantially constant, whilst the pressure that is applied at 180° is reduced. It should be noted that the inclination along line T-T and the inclination along line $S_i$-$S_i$ are selected such that the pressure that is applied at 0° remains substantially constant, so as to avoid slippage between the portion 908 of the tubular work piece 204 and the rollers 904.

Referring still to FIGS. 9-11, the apparatus further includes a work piece support assembly 914, which in the instant example includes a mechanism such as for instance a plurality of rollers (not shown) for feeding the tubular work piece 204 in the axial direction. A tube-clamping device 916 is provided, in association with a tube turning device 918, for supporting the tubular work piece 204 and for rotating the tubular work piece such that bends or curves can be formed in different directions in different portions of the tubular work piece. Optionally, rotating the tubular work piece 204 may be performed during bending, so as to form spirals or other three-dimensional shapes. A mandrel support (not shown) supports an inner mandrel 922, which is used to provide a more stable process. The mandrel 922 may extend past the location of the rollers 904, in which case thinning of the wall material of the tubular work piece 204 is achieved without reducing the tube diameter, or the mandrel 922 may be withdrawn slightly such that tube diameter reduction and tube elongation is achieved.

In the specific and non-limiting example that is shown in FIGS. 9-11, the apparatus comprises four of the rollers 904. Of course, only two of the rollers 904 are visible in the plane of the cross-section that is shown in FIG. 11. Optionally, a number of rollers 904 other than four are provided.

Figure 12:
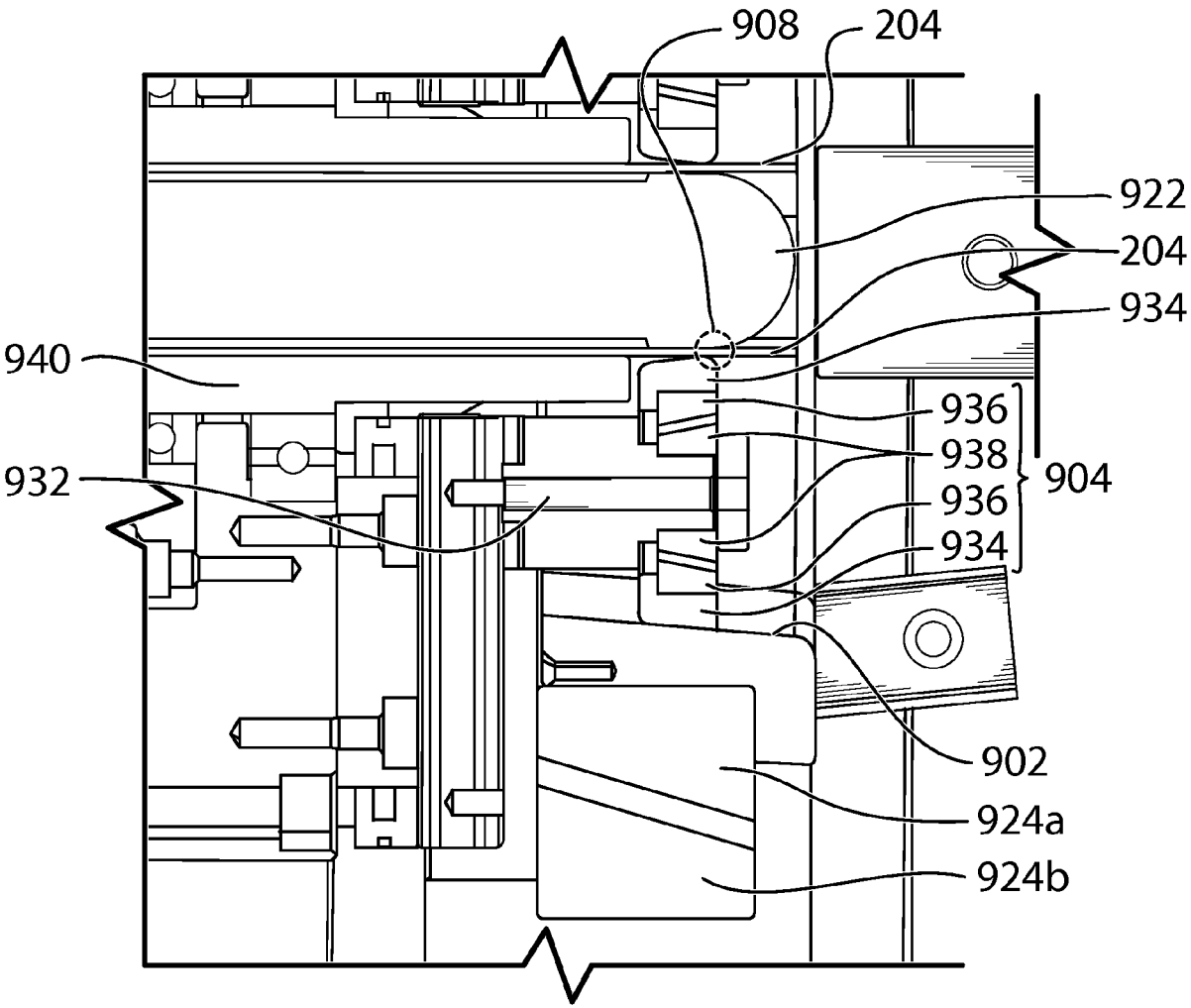
FIG. 12 is an enlarged view showing detail of the mounting structure for one of the rollers of FIG. 9.

FIG. 12 is an enlarged view of the bottom right portion of FIG. 11, showing the structure for mounting one of the rollers 904. Each of the other three rollers is mounted in substantially the same way. In particular, roller 904 is mounted on a body 932 via a bearing having an outer race 936 and an inner race 938. A roller wheel 934, fabricated from a suitable material, rotates with the outer race 936 as the roller 904 is guided along a path around the perimeter of the tubular work piece 204. The roller wheel 934 has a curved surface where it engages the portion 908 of the tubular work piece 204. The roller wheel 934 also runs along the surface 902. To this end, the roller wheel 934 is tapered in a direction that is complimentary to the direction of inclination of the surface 902. Since the roller wheel 934 is moving in opposite directions where it engages the surface 902 and the portion 908 of the tubular work piece 204, it is necessary that the roller guide assembly 900 also rotate. In particular, if the rollers are guided along a path in the clock-wise direction then the roller guide assembly 900, and consequently the surface 902, must also rotate in the clock-wise direction. The bearing assembly 924 supports rotation of the roller guide assembly 900, and reduces slippage between the roller wheels 934 and the surface 902. Also shown in FIG. 12 is a bushing 940, which supports and stabilizes the tubular work piece proximate the portion 908 within which a bend or curve is to be formed.

Figure 13:
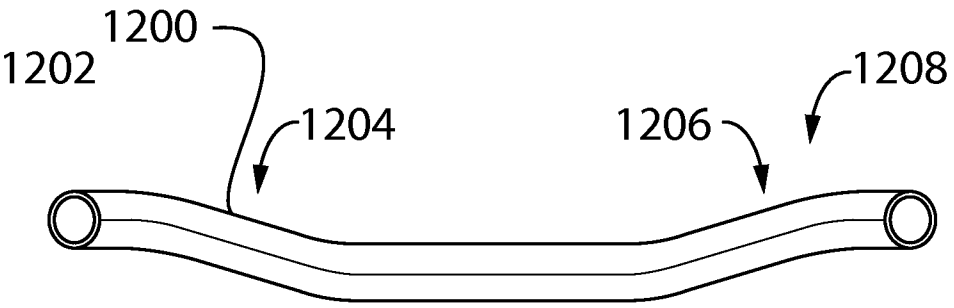
FIG. 13 shows a rear view of a cross tube that was formed according to an embodiment of the instant invention.
Figure 14:
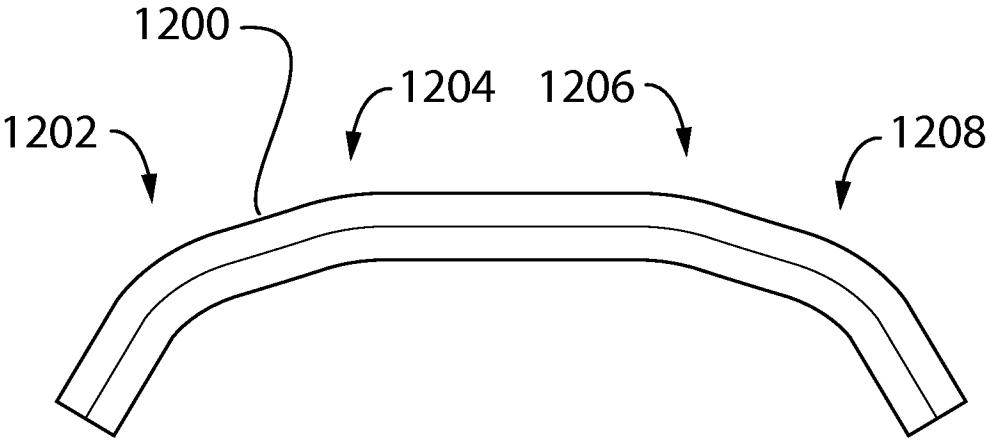
FIG. 14 is a top view of the cross tube of FIG. 13.
Figure 15:
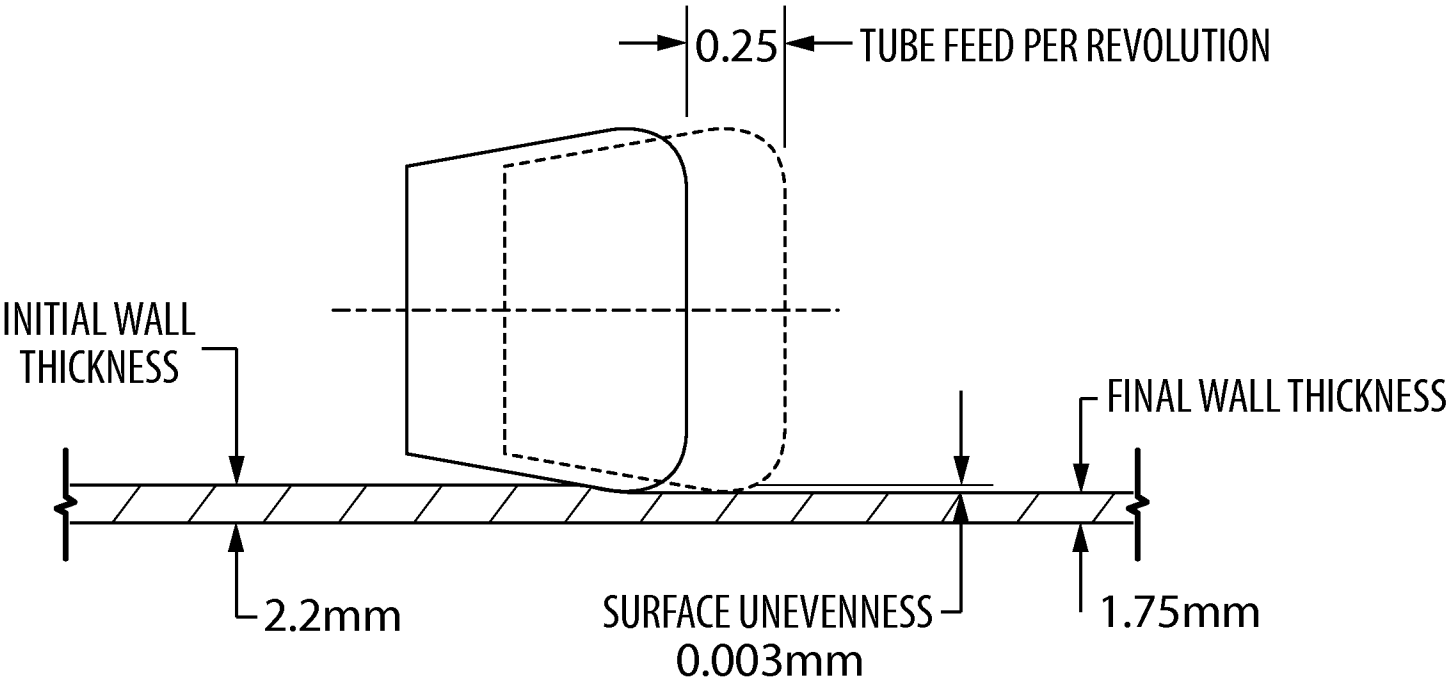
FIG. 15 is an enlarged cross-sectional side view showing thinning of the wall material of a tubular work piece, when the tubular work piece is formed according to an embodiment of the instant invention.

FIG. 13 shows a rear view of a cross tube 1200 that was formed according to an embodiment of the instant invention. FIG. 14 is a top view of the cross tube 1200 of FIG. 13. FIG. 15 is an enlarged cross-sectional side view showing the thinning of the wall material when the cross tube 1200 of FIGS. 13 and 14 is formed from tubular straight stock, according to an embodiment of the instant invention. The cross tube 1200 was formed from circular stock, having a diameter of 75 mm and a wall thickness of 2.2 mm. The tube length was 1350 mm. Using four rollers, a spinning wheel speed of 3000 rpm and an axial feed of 0.25 mm per revolution, the cross tube 1200 was formed with two bends 1202 and 1206 of 30° each, and two bends 1204 and 1208 of 15° each. In this specific and non-limiting example, an unevenness of the tube surface of 0.003 mm was achieved, accompanied by a reduction in the wall thickness from 2.2 mm to 1.75 mm. Further, the process time for each 30° bend was 0.88 seconds and for each 15° bend was 0.44 seconds. With 5.0 seconds for manipulation, the total forming time was 7.64 seconds. In comparison, the process time for 4 bends using rotary draw bending is 20 seconds, the time for manipulation is 5 seconds, and the total processing time is 25 seconds. By using the methods and devices that are described with reference to FIGS. 1-15, the production time for the cross member 1200 is reduced to about one third of the time that is required using rotary draw bending.

While the above description constitutes a plurality of embodiments of the present invention, it will be appreciated that the present invention is susceptible to further modification and change without departing from the fair meaning of the accompanying claims.

What is claimed is:

1. A method of forming a bend in a portion of a tubular work piece, comprising:

providing a tubular work piece absent a bend in the portion;

using a plurality of rollers, applying non-uniform pressure around the perimeter of the portion of the tubular work piece;

adjusting the non-uniform pressure applied by the rollers around the perimeter of the portion of the tubular work piece by moving a roller guide structure, which radially surrounds the rollers and extends axially past opposite axial sides of the rollers, in an axial and radial direction that is inclined relative to the axial direction; and, advancing the tubular work piece in an axial direction during the step of applying the non-uniform pressure, wherein each roller of the plurality of rollers is guided along a path that runs around the perimeter of the portion of the tubular work piece and transverse to the axial direction, and each roller applies the non-uniform pressure while being guided along said path, such that the tubular work piece is elongated to different extents around the perimeter of the portion of the tubular work piece, thereby forming the bend.

2. A method according to claim 1, comprising providing a mandrel within the tubular work piece prior to applying the non-uniform pressure around the perimeter of the portion of the tubular work piece, the mandrel for supporting the tubular work piece proximate the portion during the step of applying the non-uniform pressure.

3. A method according to claim 1, comprising varying at least one of i) a rate at which the tubular work piece is advanced in the axial direction, and ii) a roller pressure that is exerted by the rollers on the tubular work piece, for selecting a radius of the bend that is formed.

4. A method according to claim 3, wherein the step of varying is performed during forming the bend in the portion of the tubular work piece.

5. A method according to claim 3, wherein the step of varying is performed subsequent to forming the bend in the portion of the tubular work piece and prior to forming another bend in another portion of the tubular work piece.

6. A method according claim 1, wherein the bend is a single radius bend.

7. A method according to claim 1, wherein the bend is a progressive bend.

8. A method according to claim 1, wherein providing the tubular work piece comprises a step of clamping one end of the tubular work piece, the tubular work piece having a central longitudinal axis extending between the clamped end and the portion of the tubular work piece, and wherein clamping supports rotational movement of the tubular work piece about the central longitudinal axis.

9. A method according to claim 8, wherein the path that runs around the perimeter of the portion of the tubular work piece is substantially circular, the substantially circular path having a diameter and having a central point that is not aligned with a central longitudinal axis of the tubular work piece.

10. A method according to claim 9, comprising shifting the central point of the substantially circular path, relative to the central longitudinal axis, and simultaneously changing the diameter of the substantially circular path, wherein the central point is shifted by a predetermined distance in order to compensate for the change in the diameter of the substantially circular path, such that an amount of pressure that is exerted on the tubular work piece by the rollers remains substantially constant at a point along the perimeter.

11. A system for forming a bend in a portion of a tubular work piece, comprising:

a roller assembly comprising a plurality of rollers;

a support assembly for supporting the tubular work piece such that the portion of the tubular work piece is aligned with the plurality of rollers along an axial direction, and for advancing the tubular work piece in the axial direction;

a roller guide structure which radially surrounds at least some of the rollers and which extends axially past opposite axial sides of the rollers and which is configured to guide at least some of the rollers of the plurality of rollers along a path that runs around a perimeter of the portion of the tubular work piece and transverse to the axial direction, such that a pressure that is exerted by each of the at least some of the rollers on the portion of the tubular work piece increases from a minimum value to a maximum value along a first half of the path and decreases from the maximum value to approximately the minimum value along a second half of the path, the first half of the path not overlapping with the second half of the path; and, an adjuster assembly for moving the roller guide structure along an axial and radial direction that is inclined relative to the axial direction for varying the maximum value of the applied pressure.

12. A system according to claim 11, comprising a mandrel supported within the tubular work piece for being positioned along the axial direction up to the portion of the tubular work piece.

13. A system according to claim 11, wherein the roller guide structure comprises a surface that is inclined with respect to the axial direction so as to define a frusto-conical shaped volume, and wherein the portion of the tubular work piece is disposed within the frusto-conical shaped volume during forming the bend.

14. A system according to claim 13, wherein the at least some of the rollers are second rollers of the roller assembly and wherein the roller assembly further comprises a plurality of first rollers, each one of the plurality of first rollers disposed in rolling engagement with the surface of the roller guide structure.

15. A system according to claim 14, comprising a plurality of roller frames, each roller frame extending in a radial direction away from the tubular work piece, and each roller frame supporting one second roller and supporting one first roller, wherein a spacing between the second roller and the first roller mounted to a same roller frame is fixed.

16. A system according to claim 13, wherein the at least some of the rollers are disposed in rolling engagement with the surface of the roller guide structure.

17. A system according to claim 16, comprising a bearing assembly including an outer race and an inner race that is nested within the outer race, the roller guide assembly being mounted to the inner race of the bearing assembly for supporting rotation of the roller guide assembly, about a central axis of the bearing assembly, during of guiding the at least some of the rollers along the path around the perimeter of the portion of the tubular work piece.

18. A system according to claim 17, wherein the outer race of the bearing assembly is mounted to a frame, and wherein the frame is mechanically coupled to the adjuster assembly such that the frame, the bearing assembly and the roller guide structure are moveable as a unit along the direction that is inclined relative to the axial direction.

19. A system according to claim 11, comprising a clamping mechanism for clamping one end of the tubular work piece, the one end being spaced apart from the portion of the tubular work piece.

20. A system according to claim 19, comprising a bushing for supporting the tubular work piece proximate the portion.

21. A system according to claim 19, comprising a tube turning device for rotating the tubular work piece about a central longitudinal axis extending between the one end of the tubular work piece and the portion.

22. A system according to claim 13, wherein the path along which the at least some of the rollers are guided passes through a first reference point at 0° and through a second reference point at 180° that is diametrically opposite the first reference point, and wherein moving the roller guide structure along the direction that is inclined relative to the axial direction changes an amount of pressure that is exerted by the rollers at the second reference point more than at the first reference point.

23. A system according to claim 11, comprising a support structure for vertically moving the roller guide structure and the adjuster assembly relative to the roller assembly and the tubular work piece.

24. A system for forming a bend in a first portion of a tubular work piece, comprising:

a clamping element for clamping the tubular work piece about a second portion thereof and for aligning the clamped second portion of the tubular work piece along an axial direction;

a roller guide structure having an inwardly facing surface that is inclined, relative to the axial direction, such that the surface defines a substantially frusto-conical volume;

a tube feeding assembly for feeding the tubular work piece along the axial direction, so as to position the first portion of the tubular work piece at least partially within the substantially frusto-conical volume;

a roller assembly comprising a plurality of rollers, each roller of the plurality of rollers disposed in rolling engagement with the surface of the roller guide structure, and each roller being guided along a path that runs around a perimeter of the first portion of the tubular work piece and transverse to the axial direction;

a support structure; and, an adjuster assembly interconnecting the roller guide structure and the support structure, the adjuster assembly comprising a guide mechanism defining a guided path that is inclined relative to the axial direction for moving the roller guide structure in both a vertical and a horizontal direction relative to the roller assembly, wherein moving the roller guide structure along the guided path varies an amount of pressure that is exerted on the tubular work piece by the rollers to a larger extent within a first section of the perimeter of the tubular work piece than within a second section of the perimeter of the tubular work piece, the first section of the perimeter being opposite the second section of the perimeter.

25. A system according to claim 24, comprising a mandrel supported within the tubular work piece for being positioned along the axial direction up to the first portion of the tubular work piece.

26. A system according to claim 24, wherein the roller guide structure is configured such that an amount of pressure that is exerted on the tubular work piece by each of the rollers increases from a minimum value to a maximum value along a first half of the path and decreases from the maximum value to approximately the minimum value along a second half of the path, the first half of the path not overlapping with the second half of the path, and wherein the minimum pressure is exerted by the rollers within the first section of the perimeter of the tubular work piece and the maximum pressure is exerted by the rollers within the second section of the perimeter of the tubular work piece.

27. A system according to claim 24, comprising a bearing assembly including an outer race and an inner race that is nested within the outer race, the roller guide assembly being mounted to the inner race of the bearing assembly for supporting rotation of the roller guide assembly about a central axis of the bearing assembly.

28. A system according to claim 27, wherein the outer race of the bearing assembly is mounted to a frame, and wherein the frame is mechanically coupled to the adjuster assembly such that the frame, the bearing assembly and the roller guide structure are moveable as a unit along the guided path that is inclined relative to the axial direction.

29. A system according to claim 24, comprising a bushing for supporting the tubular work piece proximate the first portion.

30. A system according to claim 24, comprising a tube turning device for rotating the tubular work piece about a central longitudinal axis extending between the clamped second portion of the tubular work piece and the first portion of the tubular work piece.

31. A system according to claim 24, wherein the support structure comprises a mechanism for vertically moving the roller guide structure and the adjuster assembly relative to the roller assembly and the tubular work piece.

32. A system for forming a bend in a first portion of a tubular work piece, comprising:

a clamping element for clamping the tubular work piece about a second portion thereof and for aligning the clamped second portion of the tubular work piece along an axial direction;

a roller guide structure having an inwardly facing surface that is inclined, relative to the axial direction, such that the surface defines a substantially frusto-conical volume;

a tube feeding assembly for feeding the tubular work piece along the axial direction, so as to position the first portion of the tubular work piece at least partially within the substantially frusto-conical volume;

a roller assembly comprising a plurality of first rollers and a plurality of second rollers, each one of the plurality of second rollers disposed in a fixed arrangement relative to a different one of the plurality of first rollers, each first roller of the plurality of first rollers disposed in rolling engagement with the surface of the roller guide structure, and each second roller of the plurality of second rollers being guided along a path that runs around a perimeter of the first portion of the tubular work piece and transverse to the axial direction;

a support structure; and, an adjuster assembly interconnecting the roller guide structure and the support structure, the adjuster assembly comprising a guide mechanism defining a guided path that is inclined relative to the axial direction for moving the roller guide structure in both a vertical and a horizontal direction relative to the roller assembly, wherein moving the roller guide structure along the guided path varies an amount of pressure that is exerted on the tubular work piece by each of the second rollers to a larger extent within a first section of the perimeter of the tubular work piece than within a second section of the perimeter of the tubular work piece, the first section being opposite the second section.

33. A system according to claim 32, comprising a mandrel supported within the tubular work piece for being positioned along the axial direction up to the first portion of the tubular work piece.

34. A system according to claim 32, wherein the roller guide structure is configured such that an amount of pressure that is exerted on the tubular work piece by each of the second rollers increases from a minimum value to a maximum value along a first half of the path and decreases from the maximum value to approximately the minimum value along a second half of the path, the first half of the path not overlapping with the second half of the path, and wherein the minimum pressure is exerted by the second rollers within the first section of the perimeter of the tubular work piece and the maximum pressure is exerted by the second rollers within the second section of the perimeter of the tubular work piece.

35. A system according to claim 32, comprising a plurality of roller frames, each roller frame extending in a radial direction away from the tubular work piece, and each roller frame supporting one second roller and supporting one first roller, wherein a spacing between the second roller and the first roller mounted to a same roller frame is fixed.

36. A system according to claim 32, comprising a bushing for supporting the tubular work piece proximate the first portion.

37. A system according to claim 32, comprising a tube turning device for rotating the tubular work piece about a central longitudinal axis extending between the clamped second portion of the tubular work piece and the first portion of the tubular work piece.

38. A system according to claim 32, wherein the support structure comprises a mechanism for vertically moving the roller guide structure and the adjuster assembly relative to the roller assembly and the tubular work piece.

* * * * *